US012281882B2

(12) United States Patent
Ziliani et al.

(10) Patent No.: US 12,281,882 B2
(45) Date of Patent: Apr. 22, 2025

(54) SYSTEM AND METHOD FOR THE MANAGEMENT OF A CLAY SHOOTING SESSION

(71) Applicant: FABBRICA D'ARMI PIETRO BERETTA S.P.A., Brescia (IT)

(72) Inventors: Giacomo Ziliani, Brescia (IT); Riccardo Zanardelli, Brescia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 408 days.

(21) Appl. No.: 17/770,683

(22) PCT Filed: Oct. 28, 2020

(86) PCT No.: PCT/IB2020/060083
§ 371 (c)(1),
(2) Date: Apr. 21, 2022

(87) PCT Pub. No.: WO2021/111209
PCT Pub. Date: Jun. 10, 2021

(65) Prior Publication Data

US 2022/0364835 A1 Nov. 17, 2022

(30) Foreign Application Priority Data

Dec. 5, 2019 (IT) ..... 102019000023094

(51) Int. Cl.
*F41J 9/18* (2006.01)
*F41J 5/14* (2006.01)

(52) U.S. Cl.
CPC .. *F41J 5/14* (2013.01); *F41J 9/18* (2013.01)

(58) Field of Classification Search
None
See application file for complete search history.

(56) References Cited

U.S. PATENT DOCUMENTS 10,746,512 B2 * 8/2020 Howe ..... F41J 9/00
11,727,666 B2 * 8/2023 Clauson ..... G06V 10/44 382/103

(Continued)

FOREIGN PATENT DOCUMENTS

WO 2017145122 A1 8/2017

OTHER PUBLICATIONS

International Search Report, issued in PCT/IB2020/060083, mailed Mar. 3, 20201, Rijswijk, NL.

*Primary Examiner* — Sunit Pandya
(74) *Attorney, Agent, or Firm* — ArentFox Schiff LLP; Michael Fainberg

(57) ABSTRACT

A system for managing a clay shooting session is provided. The system includes hardware and software control means and a user interface operatively connected to the hardware and software control means. The user interface has a lost clay target button, a second barrel shot button, and a no-target button. In the event of pressing the no-target button, the hardware and software control means are configured to check whether a data set stored before pressing the no-target button includes at least one of data relating to a shot taken signal, data relating to pressing the second barrel shot button, and data relating to pressing the lost clay target button; if so, the data set stored before pressing the no-target button is stored and the data set relating to the shot after the no-target button is pressed is identified as a repeated shot.

7 Claims, 3 Drawing Sheets

(56) References Cited

U.S. PATENT DOCUMENTS

| | | | | |
|---|---|---|---|---|
| 2010/0102512 | A1* | 4/2010 | Dar | F41J 9/18 273/362 |
| 2015/0091252 | A1* | 4/2015 | Chadwick | F41J 11/00 273/359 |
| 2016/0223298 | A1* | 8/2016 | Drahota | F41J 5/14 |
| 2019/0186876 | A1 | 6/2019 | Howe | |
| 2020/0348111 | A1* | 11/2020 | Howe | G01S 13/66 |
| 2021/0156652 | A1* | 5/2021 | Løkka | F41J 5/10 |

* cited by examiner

SYSTEM AND METHOD FOR THE MANAGEMENT OF A CLAY SHOOTING SESSION

CROSS-REFERENCE TO RELATED APPLICATIONS

This application is a National Phase Application of PCT International Application No. PCT/IB2020/060083, having an International Filing Date of Oct. 28, 2020 which claims priority to Italian Application No. 102019000023094 filed Dec. 5, 2019, each of which is hereby incorporated by reference in its entirety.

FIELD OF THE INVENTION

The present invention relates to the field of the sports practice of clay shooting, and in particular relates to a system for the management of a clay shooting session.

BACKGROUND OF THE INVENTION

As is known, clay shooting is a sports discipline consisting in hitting a moving target (the clay target) by means of a smooth-bore rifle, from a predetermined distance from a clay target thrower machine. The shooter, located on a specific shooting station, arbitrarily decides when the clay target is thrown by vocally emitting a loud and short conventional sound, generally the word "pull".

Clay shooting is practiced in specialized facilities referred to as TAVs (clay shooting ranges), where there are one or more areas referred to as shooting fields, which include one or more clay target throwers for releasing clay targets to hit, which are managed by a corresponding electronic control unit.

Each discipline establishes how the shooting activity is carried out, the number and type of clay target thrown, the release position, direction, and trajectory the clay target should follow.

The electronic control units control the various machines for releasing the clay targets on the basis of specific sequences dictated by the discipline and upon a vocal command imparted by the shooter.

Each field is equipped with various shooting stations (they depend on the discipline) which in turn are occupied by the shooters; the alternation of the shooters on the various shooting stations is binding and established by the discipline. Each shooting station is equipped with a device suitable to vocally activate the release of the clay target, referred to as a "Phonopull".

The control units are also capable of receiving certain inputs from pushbutton stations on the field with which, during a competition, the judge can communicate the outcome of the shot (for example, the clay target was missed) rather than the need to repeat the release of a clay target due to a malfunction of the release machine. This second possibility is usually also given to the shooters by means of a button close to the phonopull.

There usually are monitors on the fields which allow the progress of the clay targets released during a shooting session (usually consisting of 25 clay targets), the outcome of the shots (shots made or missed) and, for certain types of control unit technology, the direction of release of the clay targets (right center left), to be displayed for the duration of the competition.

Certain control units further allow measuring and displaying the reaction time, intended as the time interval between the release of the individual clay target and the shot, on a display installed on the shooting field. This information is usually displayed for a few seconds between one shot and the next one.

Certain control units further provide the possibility of transmitting the detected data from the shooting field to a possible secretary's office in the TAV where the same data which can be seen on the fields are re-proposed and where there can be a PC suitable to collect the shooting data during the competitions in order to generate the classification. The name of the shooter here is manually entered during the competition registration step.

As in other sports, in order to understand how to optimize one's training activities, it is important also in the discipline of clay shooting to record the trend of one's performance not only during the competitions, but also during training.

Certain athletes write their activities down on paper and then enter them on spreadsheets, recording the training date, number of series of clay targets thrown (each series has 25 clay targets), which clay targets were missed, the scheme. This activity is very burdensome in terms of time given that at best, the shooter has to take note of the results shown on the display, at the end of the series. If the reaction times were also to be recorded, which are much more important for understanding possible mistakes made, the shooter should take note of the data at each shot taken, losing concentration for the next shot and in fact making the activity quite slow. Moreover, if there were several shooters on the shooting station, the data would be quickly replaced by the shot times of the next athlete already in shooting position. In fact, the time data can only be used by the spectators.

Certain applications exist on the market especially developed for mobile devices, which are also accessible online, which allow recording the outcome of the shots. However, these applications require the data to be entered manually. There are also Internet sites where the results of the competitions are published.

It is also customary during the training activities for the shooters to dwell on the clay targets they believe were more difficult in order to improve their ability to make the shot. This is often done using the "no-bird" or "no-target" command originally envisaged to allow the last throw to be repeated when there is a malfunction of the clay target release machine (failed release, clay target poorly released or already broken). This practice however causes the possible result of the preceding shots of the clay target voluntarily repeated to be overwritten by the new shot, in fact preventing possible progress in hitting this target from being recorded. This is because there is no specific alternative command to no-bird or no-target for indicating the voluntary repetition of a clay target because such an additional command would considerably complicate the field setup.

SUMMARY OF THE INVENTION

It is the object of the present invention to propose a system for the management of a clay shooting session capable of allowing the shooter to make his/her training sessions more effective.

Such object is achieved by a system and a method for managing a clay shooting session as described and claimed herein. Advantageous embodiments of the system and method according to the present invention are also described.

BRIEF DESCRIPTION OF THE DRAWINGS

The features and advantages of the invention will in any case become apparent from the following description of preferred embodiments thereof, given only by way of a non-limiting, indicative example, with reference to the accompanying drawings, wherein.

DETAILED DESCRIPTION

Figure 1:
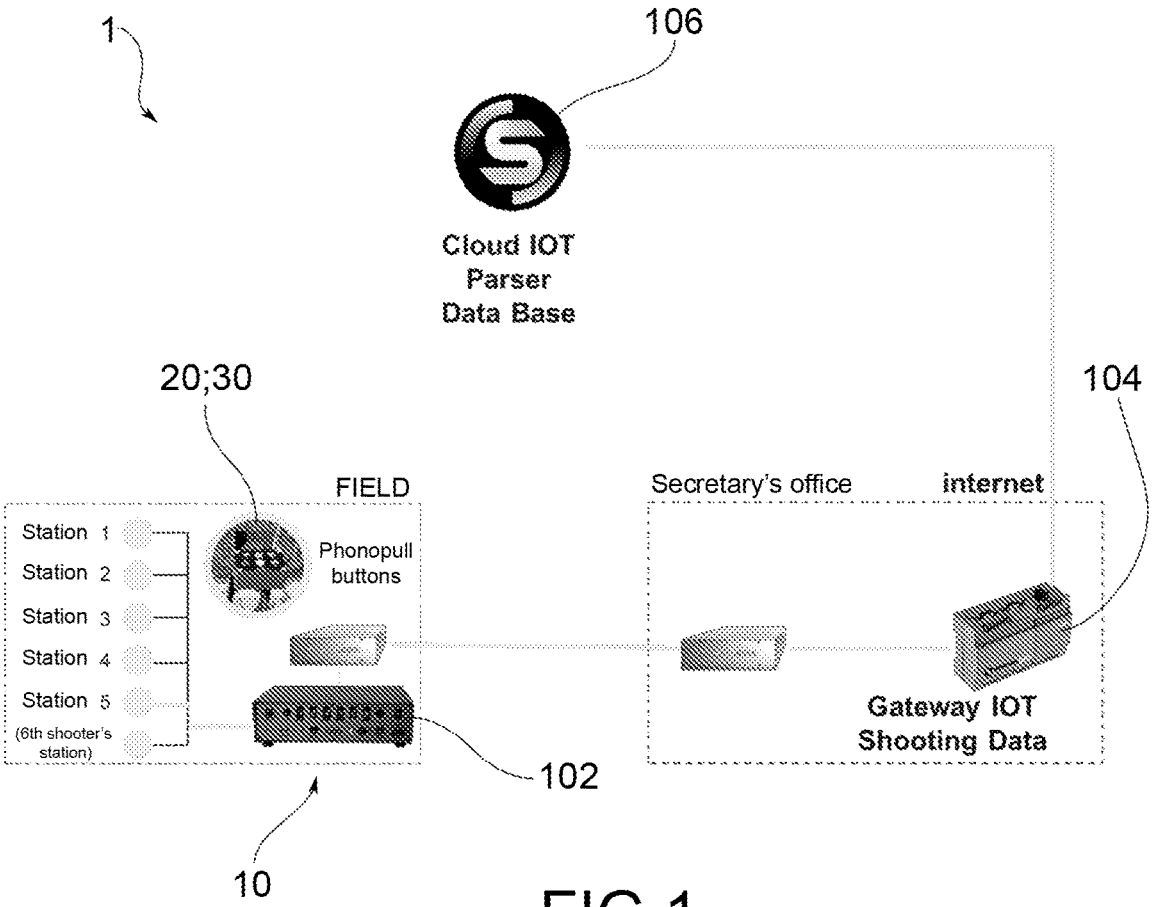
FIG. 1 diagrammatically shows a system for managing the shooting session according to the invention.
Figure 2:
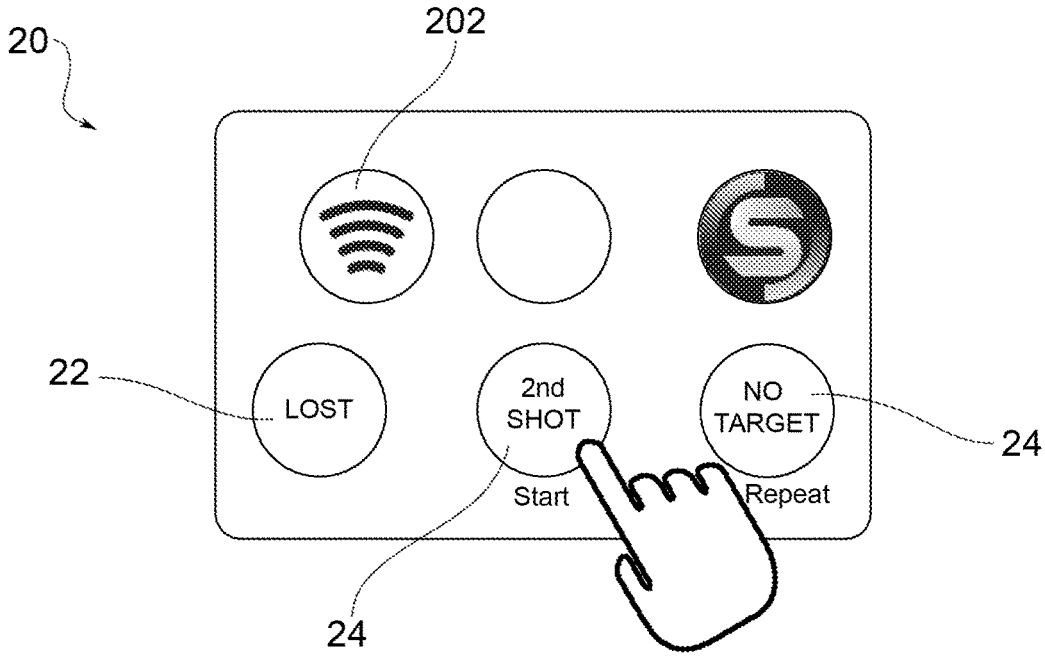
FIG. 2 shows the user interface buttons.
Figure 3:
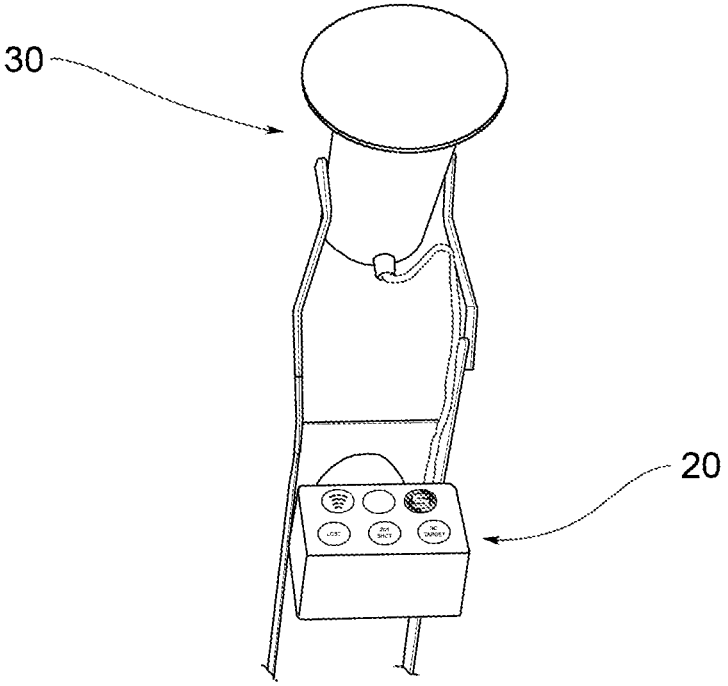
FIG. 3 shows a voice command detection device, or "phonopull", provided with a user interface of the system according to the invention.

In a general embodiment, the system for the management of a clay shooting session, indicated as a whole by 1, with reference to an embodiment shown in FIG. 1, comprises session control hardware and software means 10 and a user interface 20 operatively connected to the hardware and software control means 10.

The user interface 20 comprises a plurality of user buttons operable by a user following the execution of a shot. In particular, the user interface 20 comprises:

- a first button 22 for a missed clay target,
- a second button 24 for a second barrel shot taken, and
- a third button 26 for a no-target, also known as "no-bird" button.

The first button 22 is pushed by the shooter when his/her shot missed the clay target.

The second button 24 is pushed by the shooter when he/she hit the clay target with a second shot.

The third button 26 can be pushed by the user either when the shot is to be repeated due to a malfunction of the clay target release machine or of the clay target released (failed release, clay target released poorly or already broken), or when the shooter wants to repeat the shot just taken.

The hardware and software control means 10 are configured to:

- receive button signals operated by the respective user buttons 22, 24, 26;
- receive a voice command signal from a voice command detection device 30, or phonopull;
- receive a shot taken signal, for example by means of a sound detection of one or more shots;
- control the release of a clay target;
- store a data set relating to a shot taken.

In the event the shooter presses the no-target button 26, the hardware and software means 10 are further configured to:

- check whether the data stored before pressing the no-target button 26 include at least one of the following: data relating to the shot taken signal, data relating to pressing the second barrel shot button 24, data relating to pressing the missed clay target button 22.

If not, the hardware and software means are programmed to overwrite the data set stored before pressing the no-target button 26 with the data set relating to the shot after the no-target button 26 is pressed.

If so, the hardware and software means are programmed to keep the data set stored before pressing the no-target button 26 and identify the data set relating to the next shot as a repeated shot after the no-target button 26 is pressed.

Therefore, with one no-target button 26 alone, the shooter can conventionally request the shot just thrown be repeated due to a malfunction so that the new shot replaces the one just made (and therefore the corresponding data), or can request the shot just made be repeated because he/she actually wants to try the same shot again. Therefore, in this second case, the data relating to the first shot are not replaced by the data relating to the second shot, rather both data sets are stored and recorded to allow the shooter to make a comparison.

In one embodiment, the user interface 20 is suitable to be fastened to the voice command detection device 30. Thereby, a further device is not introduced on the shooting station, rather the phonopull, which is close to the shooter, is taken advantage of.

In one embodiment, the data set relating to the shot taken comprises one or more among: the number of shots in a predetermined shooting session, score obtained, sequence of the clay targets in the session, direction of release of each clay target in the session, shooting result for each clay target belonging to the set considered as taken, not taken or taken from a second barrel, delay of release of the clay target from the call, time interval between release of the clay target and the first shot, time interval between the first and second shot, no-target signal.

In one embodiment, the hardware and software means 10 comprise a control unit 102 operatively connectable to the user interface 20, to the voice command detection device 30, and to a clay target release machine, a gateway 104 operatively connectable to the control unit 102 and is suitable to receive, from the control unit 102, the stored data relating to the shots taken and to process said data to be sent to a remote server 106.

For example, gateway 104 is positioned in the secretary's office of the shooting facility and intercepts all the communications from the various fields of the TAV to the secretary's office. Gateway 104 accesses this information, transforms it into packets and sends it to an IOT cloud 106 for data collection. In the event of an absence of Internet connectivity, gateway 104 stores the data received in a local internal buffer. The data in the buffer is sent as soon as the Internet connectivity becomes available again.

The data can be stored and therefore processed by means of a parser which selects the packets containing useful information. The useful packets are further processed in order to extract the required information for the system for each shooting event. The information is collected in a database.

In one embodiment, the user interface 20 further comprises identity detection means 202 suitable to receive user identification data from the user and transmit the user identification data to the hardware and software means 10.

The hardware and software means 10 are configured to associate the user identification data with the data sets relating to the shots taken.

For example, the identity detection means 202 comprise an RFID or NFC reader.

Indeed, in order to associate the data from the fields with the users who generated them, one embodiment provides a mechanism to allow identifying the shooter who is shooting on a given shooting station.

The attribution of the data with the individual user occurs in the following manner.

After being registered on the shooting station using, for example a username and password, each user is provided with an RFID transponder 50 provided with a unique identification number UID contained, for example in a key ring tag (TAG). TAG can be given to the user in the secretary's office of the TAV. The username can be a valid email address or a mobile phone number. The validity of the email address or phone number is verified by sending a link which the user is to confirm to show actual access to the email address or phone number used.

The UID of the TAG is associated with the user. The association occurs just one time. Each user can have more than one TAG, but each TAG can be associated with one user alone.

In one embodiment, the TAG association operation occurs just one time according to the following modes.

The field manager uses a dashboard to search for the username and associates it with the unique identification number (UID) of the TAG by entering it (the UID is physically printed on the surface of the tag) or reading it using an NFC reader connected to the PC. When the association is carried out by the field manager, a confirmation mechanism sends a message to the email address or to the mobile phone number to allow the user to confirm the transponder UID association operation with his/her account.

The association can be carried out also by the user in SELF SERVICE mode using a smartphone application; here however, in addition to entering the UID, it is also necessary to enter a control code previously generated with an algorithm by processing the UID itself. This control code is printed on the package of the transponder itself. The control code allows the entry of incorrect UID data to be avoided. The system accepts the association of a TAG with a user only if the control code and UID entered meet the condition of the algorithm.

Figure 5:
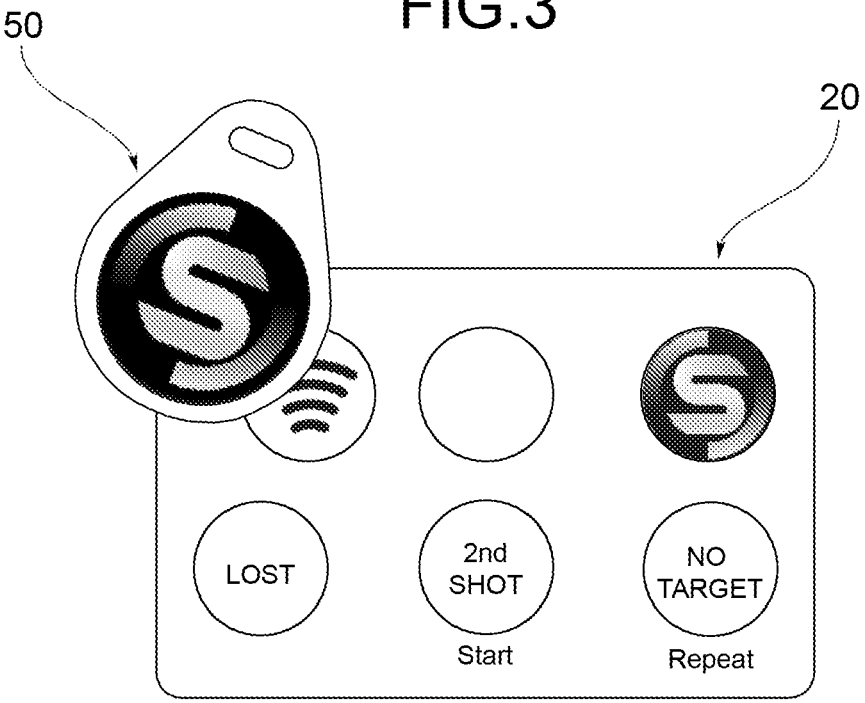
FIG. 5 shows the user interface in communication step, with a user identification device.

When the shooter is on the first shooting station provided for the discipline he is performing, he/she nears his/her TAG to reader 202 on the user interface 20 (FIG. 5) before the first clay target is thrown. A specific symbol allows locating the position of the antenna in the keypad.

In one embodiment, reader 202 is provided with a multicolor indicator light which, with a predetermined color code and/or by flashing, communicates the successful reading of the transponder and the association thereof in the control unit software with the number of the shooter who will start from that shooting station.

Once the tag UID is stored and associated with the shooter who starts on the specific shooting station, all the data sent from the control unit to the secretary's office within the scope of the 25 clay targets relating to the shooting session, referring to the shooter, are associated with the transponder UID. This also occurs when the shooter moves to the other shooting stations since the sequence of the shooting stations that the shooter occupies is defined in advance by the discipline and implemented by the control unit software. Receiving the data, the system therefore knows who the received information is to be associated with.

It is worth noting that the shooter has the option to change the starting shooting station up to pressing a START button which, for example can coincide with the second button 24 of clay target taken from a second barrel. Indeed, the nearing of the transponder to another reader in another shooting station results in the "undermining" of the UID possibly in that station and the assignment of the UID of the TAG that was just approached. Obviously, the shooting station where the TAG which changed position was originally present cancels UID. The presence or absence of a stored UID is shown up to pressing the START button using a specific activation of the indicator light (for example, flashing BLUE and GREEN no UID stored, solid BLUE UID stored).

The use of the transponder for checking in on the shooting station is advantageous for the following reasons:

- it allows the shooter to identify him/herself very quickly (just a simple gesture and the reading is substantially instantaneous, less than 1 second);
- it does not require storing usernames or passwords;
- it does not require the presence of costly interfaces such as keypads or monitors;
- given that reading the UID of the TAG is contactless, the shooter does not need to touch the phonopull to identify him/herself (this in compliance with the competition rules which prohibit touching the phonopull during a competition);
- the TAG has curbed sizes, weight, and cost;
- the TAG is not easily duplicatable, making duplication difficult;
- the TAG can be incorporated in various objects commonly worn by the shooter, and therefore brought along during the shooting activity (for example, rings, bracelets, shooting vest pockets).

In one embodiment, since they replicate the buttons of the competition judge, the buttons of the user interface 20 also activate the conventional sound warning activated when it is the judge to activate it (for example, when the missed shot button is pressed, a loud signal is emitted by means of a buzzer).

A specific sound signal can also be emitted when the clay target taken from a second barrel button is pressed.

In one embodiment which is particularly useful in the TRAP discipline, if a user does not have the identification device 50 with him/her, the data generated by a given shooting station can be claimed. Each shooting station is identified by a unique identifier. This can be a legible code, a QR code, an NFC tag fastened at the shooting station.

Before performing the series of shots, the shooter can check in on the shooting station by entering the code, scanning the QR code or nearing the telephone to the NFC tag. The data relating to that shooting station will be sent to that user.

Alternatively, the procedure can also be carried out after shooting, thus claiming the ownership of the series that just concluded.

The coherence of the GPS position detected by the mobile device when the QR code is scanned or the NFC is read with the actual position of the field, can be used to confirm the presence of the user on the field.

The readable code or QR code can be static, and therefore printed once, or also be generated dynamically and projected by means of specific monitors on the fields or in the secretary's office to ensure increased security because not only would the code identify the shooting station, but also the specific series of shots generated therefrom.

In clay shooting, considering that the shooters all start from shooting station number 1, the shooter is required to select his/her shooting order using the application.

Figure 4:
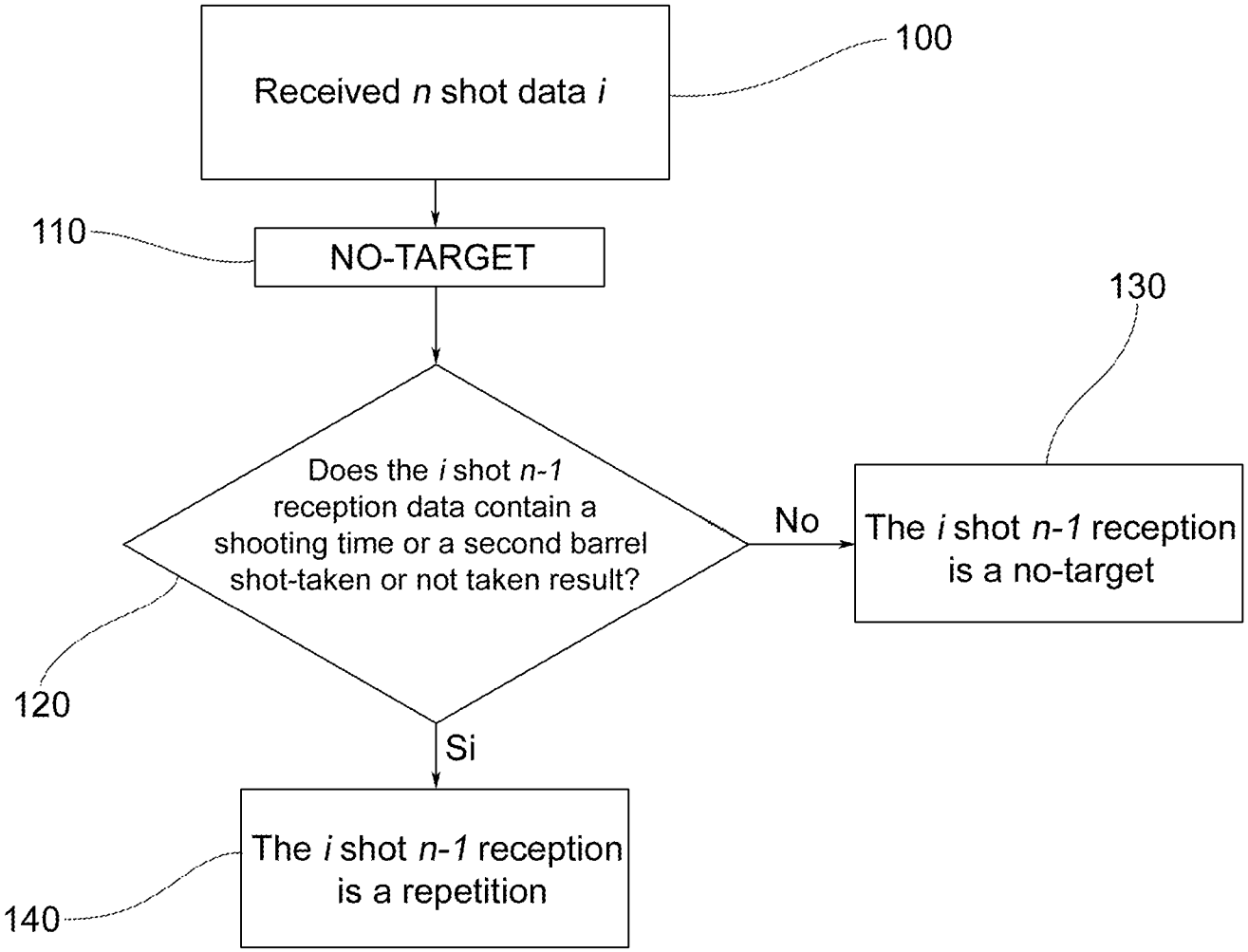
FIG. 4 is a flow chart of the repeated shot detection algorithm.

A method for managing a clay shooting session also is an object of the invention. The method uses the above-described management system. According to the flow chart in FIG. 4, the method comprises the steps of:

- storing, by hardware and software means, a data set relating to a shot taken (step 100),
- receiving a signal that the no-target button was pressed, from the hardware and software means (step 110);
- checking by the hardware and software means whether the data stored before pressing the no-target button include at least one of the following: data relating to the shot taken signal, data relating to pressing the second barrel shot button, data relating to pressing the missed clay target button (step 120);

If not, overwriting the data stored before pressing the no-target button with the data set relating to the shot after the no-target button is pressed (step 130);

If so, keeping the data set stored before pressing the no-target button and identifying the data set relating to the next shot after the no-target button is pressed as a repeated shot (step 140).

Those skilled in the art can make changes and adaptations to the embodiments of the system and method for the management of a clay shooting session according to the invention or can replace elements with others which are functionally equivalent to meet contingent needs without departing from the scope of the following claims. Each of the features described above as belonging to a possible embodiment can be implemented irrespective of the other embodiments described.

The invention claimed is:

1. A system for managing a clay shooting session, the system comprising hardware and software control means and a user interface operatively connected to said hardware and software control means, wherein the user interface comprises a plurality of user buttons operable by a user following execution of a shot, said plurality of user buttons comprising a first button for a missed clay target, a second button for a second barrel shot taken, and a third button for a no-target, wherein the hardware and software control means are configured to:

receive button signals operated by respective user buttons, receive a voice command signal from a voice command detection device, receive a shot taken signal, control release of a clay target, and store a data set relating to a shot taken, wherein, in the event of pressing the third button for a no-target, the hardware and software control means are further configured to:

check whether the data set stored before pressing the third button for the no-target includes at least one of: data relating to the shot taken signal, data relating to pressing the second button for the second barrel shot taken, data relating to pressing the first button for the missed clay target;

if not, the hardware and software control means are programmed to overwrite the data set stored before pressing the third button for the no-target with the data set relating to the shot after the third button for the no-target is pressed;

if so, the hardware and software control means are programmed to keep the data set stored before pressing the third button for the no-target and identify as a repeated shot the data set relating to the shot after the third button for the no-target is pressed.

2. The system of claim 1, wherein the user interface is configured to be fixed to the voice command detection device.

3. The system of claim 1, wherein the data set relating to the shot taken comprises one or more among: number of shots within a predetermined shooting session, score obtained, sequence of clay targets within the shooting session, direction of release of each clay target within the shooting session, shooting result for each clay target considered as taken, not taken or taken from a second barrel, delay of release of the clay target from call, time interval between release of the clay target and a first shot, time interval between the first shot and a second shot, no-target signal.

4. The system of claim 1, wherein the hardware and software control means comprise a control unit operatively connectable to the user interface, to the voice command detection device, and to a clay target release machine, and a gateway operatively connectable to the control unit and configured to receive from the control unit stored data sets relating to shots taken and to process and send said data sets to a remote server.

5. The system of claim 1, wherein the user interface comprises identity detection means configured to receive user identification data from the user and to transmit the user identification data to the hardware and software control means, the hardware and software control means being configured to associate said user identification data to data sets relating to shots taken.

6. The system of claim 5, wherein said identity detection means comprise a radio frequency identification (RFID) reader or a near-field communication (NFC) reader.

7. A method for managing a clay shooting session, said method comprising:

providing a system comprising hardware and software control means and a user interface operatively connected to said hardware and software control means, wherein the user interface comprises a plurality of user buttons operable by a user following execution of a shot, said plurality of user buttons comprising a first button for a missed clay target, a second button for a second barrel shot taken, and a third button for a no-target, wherein the hardware and software control means are configured to:

receive button signals operated by respective user buttons, receive a voice command signal from a voice command detection device, receive a shot taken signal, control release of a clay target, and store a data set relating to a shot taken, wherein, in the event of pressing the third button for the no-target, the hardware and software control means are further configured to:

check whether the data set stored before pressing the third button for the no-target includes at least one of: data relating to the shot taken signal, data relating to pressing the second button for the second barrel shot taken, data relating to pressing the first button for the missed clay target;

if not, the hardware and software control means are programmed to overwrite the data set stored before pressing the third button for the no-target with the data set relating to the shot after the third button for the no-target is pressed;

if so, the hardware and software control means are programmed to keep the data set stored before pressing the third button for the no-target and identify as a repeated shot the data set relating to the after the third button for the no-target is pressed;

storing, by the hardware and software control means, a data set relating to a shot taken, receiving a signal that the third button for the no-target was pressed from the hardware and software control means; and checking by the hardware and software control means whether the data set stored before pressing the third button for the no-target includes at least one of: data relating to the shot taken signal, data relating to pressing the second button for the second barrel shot taken, data relating to pressing the first button for the missed clay target;

if not, overwriting the data set stored before pressing the third button for the no-target with the data set relating to the shot after the third button for the no-target is pressed;

if so, keeping the data set stored before pressing the third button for the no-target and identify as a repeated shot the data set relating to the shot after the third button for the no-target is pressed.

* * * * *